US009776426B2

(12) United States Patent
Ohnishi et al.

(10) Patent No.: US 9,776,426 B2
(45) Date of Patent: Oct. 3, 2017

(54) INKJET PRINTING DEVICE AND PRINTING METHOD

(71) Applicant: MIMAKI ENGINEERING CO., LTD., Nagano (JP)

(72) Inventors: Masaru Ohnishi, Nagano (JP); Kosuke Murai, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/771,499

(22) PCT Filed: Mar. 7, 2014

(86) PCT No.: PCT/JP2014/056063
§ 371 (c)(1),
(2) Date: Aug. 30, 2015

(87) PCT Pub. No.: WO2014/136968
PCT Pub. Date: Sep. 12, 2014

(65) Prior Publication Data

US 2016/0016421 A1 Jan. 21, 2016

(30) Foreign Application Priority Data

Mar. 7, 2013 (JP) ..... 2013-045980

(51) Int. Cl.
*B41J 2/21* (2006.01)
*B41J 25/00* (2006.01)
*B41J 2/51* (2006.01)

(52) U.S. Cl.
CPC ..... *B41J 2/2135* (2013.01); *B41J 2/2132* (2013.01); *B41J 25/001* (2013.01); *B41J 2/512* (2013.01)

(58) Field of Classification Search
CPC ..... B41J 2/2132; B41J 2/2135; B41J 2/512; B41J 25/001
(Continued)

(56) References Cited

U.S. PATENT DOCUMENTS 6,019,453 A * 2/2000 Tsuruoka ..... B41J 2/04541 347/40
2001/0006392 A1* 7/2001 Otsuki ..... B41J 19/142 347/9
(Continued)

FOREIGN PATENT DOCUMENTS

CN 1836908 9/2006
JP 2005-67049 3/2005
(Continued)

OTHER PUBLICATIONS

"International Search Report (Form PCT/ISA/210)", dated Jun. 10, 2014, with English translation thereof, pp. 1-3, in which three of the listed references (JP2007-15136A, JP2005-67049A and JP2011-79331A) were cited.
(Continued)

*Primary Examiner* — Sharon A Polk
(74) *Attorney, Agent, or Firm* — Jiang Chyun Intellectual Property Office

(57) ABSTRACT

An aim is to provide a technique for obtaining a higher quality print image by reducing a banding caused upon printing using a printing head having nozzle rows. As a solution, an activated nozzle row is reselected each time when the activated nozzle row has discharged ink for a preset number of times, and in each scan, an interval by which the activated nozzle row discharges ink in a main scanning direction is set to be an integer multiple of a resolution of an image to be printed on a print medium in the main scanning direction.

3 Claims, 11 Drawing Sheets

(58) Field of Classification Search
USPC ..... 347/5, 9, 12
See application file for complete search history.

(56) References Cited

U.S. PATENT DOCUMENTS

| | | | | |
|---|---|---|---|---|
| 2006/0214957 | A1* | 9/2006 | Wada | B41J 2/0458 347/5 |
| 2007/0008364 | A1* | 1/2007 | Ishimoto | B41J 2/2132 347/15 |
| 2012/0162322 | A1* | 6/2012 | Tsuchiya | B41J 2/175 347/85 |

FOREIGN PATENT DOCUMENTS

| | | | |
|---|---|---|---|
| JP | 2005067049 | A * | 3/2005 |
| JP | 2007-15136 | | 1/2007 |
| JP | 2008-155399 | | 7/2008 |
| JP | 2008155399 | A * | 7/2008 |
| JP | 2009226904 | | 10/2009 |
| JP | 2011-79331 | | 4/2011 |
| JP | 2011079331 | A * | 4/2011 |

OTHER PUBLICATIONS

"Office Action of China Counterpart Application", dated Mar. 18, 2016, with English translation thereof, p. 1-p. 14, in which the listed references were cited.
"Office Action of Japan Counterpart Application" with English translation thereof, issued on Sep. 6, 2016, p. 1-p. 8.

* cited by examiner

INKJET PRINTING DEVICE AND PRINTING METHOD

CROSS-REFERENCE TO RELATED APPLICATION

This application is a 371 of international application of PCT application serial no. PCT/JP2014/056063, filed on Mar. 7, 2014, which claims the priority benefit of Japan application no. JP 2013-045980, filed on Mar. 7, 2013. The entirety of each of the above-mentioned patent applications is hereby incorporated by reference herein and made a part of this specification.

TECHNICAL FIELD

The present invention relates to an inkjet printing device and a printing method, and especially relates to an inkjet printing device and a printing method that performs printing by using a printing head that includes nozzle rows having a plurality of nozzles aligned therein.

BACKGROUND ART

In a serial-type inkjet printing device, a problem is known in which bands formed in respective times of scans overlap each other, whereby a banding (streaked pattern) is generated. To solve this problem, a technology is in development in which a part of the nozzle rows is selected as an activated nozzle row that discharges ink and is caused to scan over a print medium, and a position of the activated nozzle row is changed (Patent Document 1).

PRIOR ART DOCUMENT

Patent Document

Patent Document 1: JP 2008-155399 A (published on Jul. 10, 2008).

SUMMARY OF THE INVENTION

Problem to be Solved by the Invention

It would be very useful if a printing technique that can obtain a higher quality print image than the technique described in Patent Document 1 can be provided. Especially, in the technique described in Patent Document 1, there are occasions where vertical lines are prominently visible in the obtained print image, or the banding can be seen, and it would be preferable if these can be resolved.

The present invention has been made in view of the above problem, and aims to provide a technique for reducing a banding caused upon printing by using a printing head having nozzle rows, and obtaining a higher quality print image.

Solutions to the Problem

To solve the above problem, an inkjet printing device according to the present invention includes: a printing head including at least one nozzle row having a plurality of nozzles aligned therein; a nozzle selecting unit that selects, for each nozzle row, a plurality of nozzles aligned continuously in a part of the nozzle row as an activated nozzle row; a main scan controlling unit that causes the printing head to scan in a main scanning direction intersecting the nozzle row; and a sub scan controlling unit that causes a print medium to move with respect to the printing head in a sub scanning direction that is parallel to a direction along which the nozzle row extends, wherein printing is performed by the main scan controlling unit causing the printing head to scan in the main scanning direction and the activated nozzle row discharging ink onto the print medium, the nozzle selecting unit selects the activated nozzle row each time when the activated nozzle row has discharged ink for a preset number of times, such that a shift amount of the activated nozzle row from one end of the nozzle row is changed, and in each scan, an interval by which the activated nozzle row in each nozzle row discharges ink in the main scanning direction is set to be an integer multiple of a resolution of an image to be printed on the print medium in the main scanning direction.

According to the above configuration, printing is performed by discharging the ink from the activated nozzle row. At this occasion, the shift amount (position) of the activated nozzle row that is to discharge the ink is changed by the nozzle selecting unit, so that banding can be reduced by dispersing boundaries between bands at different positions front and back in the sub scanning direction.

Here, if vertical lines adjacent to each other in the main scanning direction are to be printed by the activated nozzle row in the same nozzle row, there are cases where the vertical lines stand out, or the banding is slightly visible in the obtained print image due to properties provided by the nozzle row. With respect to this, according to the above configuration, printing is performed in each scan so that the interval by which the activated nozzle row in each nozzle row discharges the ink in the main scanning direction is set to be the integer multiple of the resolution of the image to be printed on the print medium in the main scanning direction. That is, in each scan, the activated nozzle row in the same nozzle row is configured not to print the vertical lines that are adjacent in the main scanning direction within the print image. Accordingly, the vertical lines that are adjacent in the main scanning direction within the print image are printed by the activated nozzle rows of different nozzle rows, or by different scans. Thus, regions printed by the activated nozzle row in the same nozzle row, or regions printed by the same scan are dispersed within the print image, so that property variations among the nozzle rows or variations in print state (including transfer error) among the scans are averaged, whereby vertical lines, banding, and the like in the print image can further be suppressed. Due to this, a higher quality print image can be obtained.

In the inkjet printing device as above, the printing head preferably includes a plurality of the nozzle rows that discharges a same color ink.

As described above, in the inkjet printing device according to the present invention, the vertical lines that are adjacent in the main scanning direction within the print image are printed either (i) by the activated nozzle rows of different nozzle rows, or (ii) by the different scans; and due to this, a high quality print image can be obtained. Here, according to the above configuration, since the printing head includes a plurality of the nozzle rows that discharges a same color ink, the vertical lines that are adjacent in the main scanning direction within the print image can be printed (i) by the activated nozzle rows of different nozzle rows in each scan. Due to this, as compared to the case where the adjacent vertical lines are printed (ii) by the different scans, printing can be performed at high speed.

Further, by performing printing using a plurality of the nozzle rows that discharges a same color ink, the property variations among the nozzle rows are further averaged, and a higher quality print image can be obtained.

Further, with the printing head including a plurality of the nozzle rows that discharges a same color ink, in a case where a voluntary nozzle row includes a broken nozzle from which the ink cannot be discharged due to a damage or the like, printing can be performed using a nozzle of another nozzle row instead of the broken nozzle (perform recovery).

In the above inkjet printing device, the plurality of the nozzle rows may be arranged such that some of the nozzles become adjacent to each other in the main scanning direction, in each scan, printing may be performed so that a position in the main scanning direction where the activated nozzle row of each nozzle row discharges the ink differs from each other, and pixels aligned in the sub scanning direction in the image to be printed on the print medium may be formed by the activated nozzle row of a same nozzle row.

According to the above configuration, the plurality of the nozzle rows is arranged so that some of their nozzles become adjacent to each other in the main scanning direction. That is, the adjacent nozzle rows are arranged so that they are offset relative to each other in the sub scanning direction.

In printing using the plurality of nozzle rows arranged by being offset each other, the printing can be performed so that pixels aligning in the sub scanning direction (vertical lines) in the image to be printed on the print medium are formed by the activated nozzle row in the same nozzle row, and each band can suitably be printed thereby. In addition, since the vertical lines are printed by the same nozzle row, shifting of printing position in the main scanning direction in each vertical line can be suppressed.

That is, in the case of printing the vertical lines by a plurality of nozzle rows, since the printing position in the main scanning direction of each nozzle row differs due to a property variation in the respective nozzle rows, the shifting of the printing position in the main scanning direction is generated accompanying the switch between the nozzle rows that perform printing in each vertical line, but such a shifting can be suppressed by printing the vertical lines by the same nozzle row.

In the above inkjet printing device, printing may be performed by discharging the ink onto the print medium from at least one nozzle extending discontinuously from at least one end of the activated nozzle row, in addition to the activated nozzle row.

According to the above configuration, in addition to the activated nozzle row, ink is discharged from the nozzle extending discontinuously from at least one end of the activated nozzle row. Due to this, among the vertical lines in the print image, an intermediate region that is printed by the discontinuous nozzle can be provided between portions to be printed by the continuous nozzles (activated nozzle row). Due to this, the vertical lines can be freed from visibly standing out. Accordingly, a higher quality print image can be obtained.

In the above inkjet printing device, pixels aligned in the sub scanning direction in the image to be printed on the print medium may be formed by every N scan (N being an integer of one or more).

According to the above configuration, the pixels aligned in the sub scanning direction (vertical line) in the image to be printed on the print medium are formed by every N scan (N being an integer of one or more). Due to this, errors in a transfer operation in the sub scanning direction among scans of the respective occasions can be averaged, and a higher quality print image can be obtained. For example, some of pixels overlap at a boundary between the bands by the transfer errors in the sub scanning direction and a stripe pattern may thereby be generated, but according to the above configuration, the errors in the transfer operation in the sub scanning direction among the scans of the respective occasions can be averaged, and the stripe pattern can further be suppressed.

A printing method according to the present invention is a printing method that uses an inkjet printing device including a printing head that includes at least one nozzle row having a plurality of nozzles aligned therein, the method including: a nozzle selecting step of selecting, for each nozzle row, a plurality of nozzles aligned continuously in a part of the nozzle row as an activated nozzle row; a printing step of performing printing by scanning the printing head in a main scanning direction intersecting the nozzle row, and discharging ink onto a print medium from the activated nozzle row; a nozzle re-selecting step of changing a shift amount of the activated nozzle row from one end of the nozzle row each time when the activated nozzle row has discharged the ink for a preset number of times; and a sub scanning step of moving the print medium with respect to the printing head in a sub scanning direction that is parallel to a direction along which the nozzle row extends, wherein in the printing step, printing is performed such that in each scan, an interval by which the activated nozzle row in each nozzle row discharges ink in the main scanning direction is set to be an integer multiple of a resolution of an image to be printed on the print medium in the main scanning direction.

According to the above configuration, an effect similar to that of the inkjet printing device according to the present invention can be achieved.

Effects of the Invention

According to the present invention, a higher quality print image can be obtained by reducing the banding caused upon printing using a printing head having nozzle rows.

BRIEF DESCRIPTION OF THE DRAWINGS

FIG. 2A and FIG. 2B show examples in which a shift amount of an activated nozzle row from one end of the nozzle row is different.

FIG. 3A shows an example of a range in the sub scanning direction that a nozzle row can print in each scan, and FIG. 3B shows an example of a print image printed by plural scans.

FIG. 5A shows an example of a range in the sub scanning direction that each nozzle row can print in one scan, and FIG. 5B shows an example of a print image printed by one scan.

FIG. 6A shows an example of a range in the sub scanning direction that a nozzle row can print in each scan, and FIG. 6B shows an example of a print image printed by plural scans.

FIG. 8A shows an example of a range in the sub scanning direction that a nozzle row can print in each scan, and FIG. 8B shows an example of a print image printed by plural scans.

FIG. 10A shows an example of a range in the sub scanning direction that a nozzle row can print in each scan, and FIG. 10B shows an example of a print image printed by plural scans.

EMBODIMENTS OF THE INVENTION

First Embodiment

In explaining one embodiment (first embodiment) of the present invention based on FIG. 1, FIG. 2A and FIG. 2B, and FIG. 3A and FIG. 3B, such explanation will be as follows.

Figure 1:
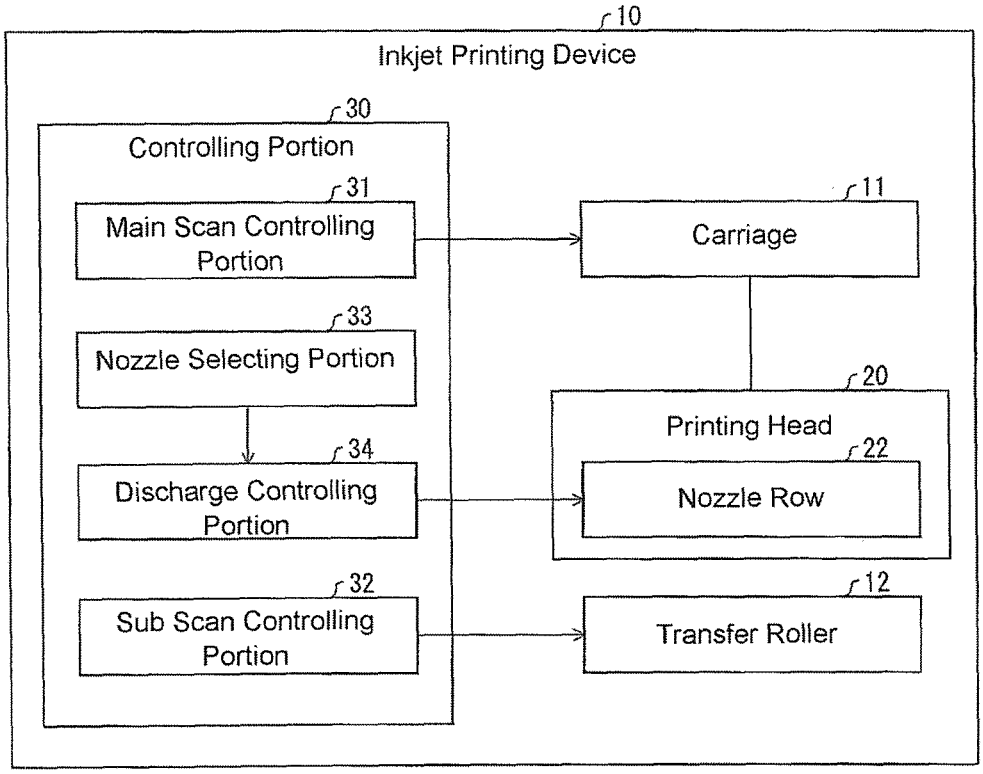
FIG. 1 is a functional block diagram showing an overview configuration of an inkjet printing device according to an embodiment of the present invention.

FIG. 1 is a functional block diagram showing an overview configuration of an inkjet printing device 10 according to an embodiment of the present invention. As shown in FIG. 1, an inkjet printing device 10 includes a carriage 11, a transfer roller 12, a printing head 20, and a controlling portion 30. The controlling portion 30 is provided with a main scan controlling portion (main scan controlling unit) 31, a sub scan controlling portion (sub scan controlling unit) 32, a nozzle selecting portion (nozzle selecting unit) 33 and a discharge controlling portion 34.

The carriage 11 is equipped with the printing head 20, and is configured movable. The main scan controlling portion 31 causes the printing head 20 to scan in a main scanning direction by controlling the carriage 11.

The transfer roller 12 is configured capable of transferring a print medium 1 that is to be a target of printing. The sub scan controlling portion 32 causes the print medium 1 to move relative to the printing head 20 in a sub scanning direction which is perpendicularly intersecting the main scanning direction by controlling the transfer roller 12.

Figure 2A:
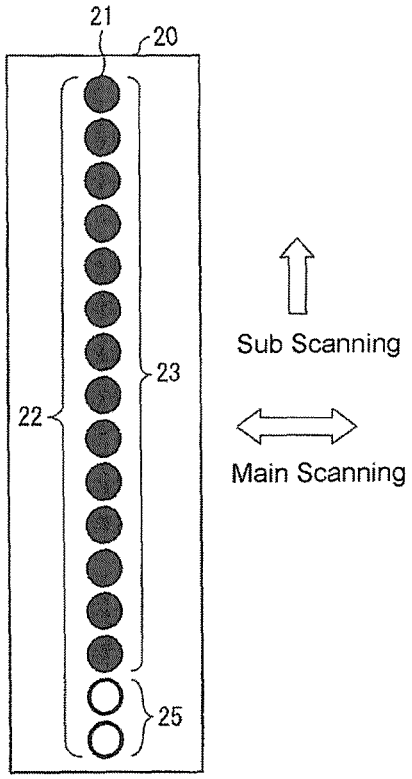
FIG. 2A and FIG. 2B are schematic diagrams showing a schematic configuration of a printing head in one embodiment of the present invention (first embodiment), where
Figure 2B:
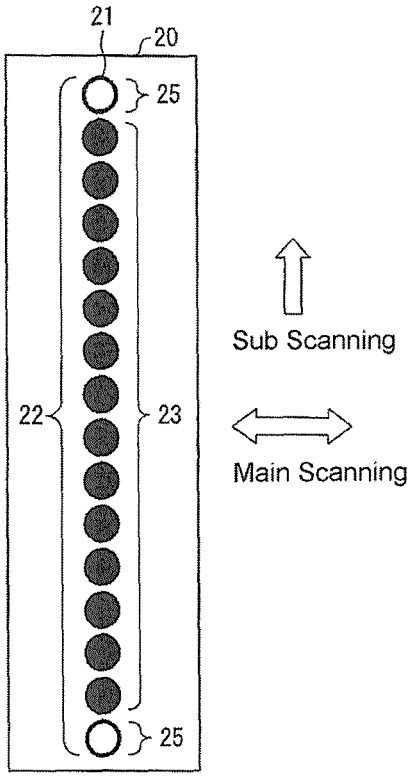

FIG. 2A and FIG. 2B are schematic diagrams showing an example of an overview configuration of the printing head 20 in the present embodiment, where FIG. 2A and FIG. 2B show examples in which a shift amount of an activated nozzle row from one end of the nozzle row is different. As shown in FIG. 2A and FIG. 2B, the printing head 20 of the present embodiment includes a nozzle row 22 in which a plurality of nozzles 21 is aligned. The nozzle row 22 perpendicularly intersects with the main scanning direction, and extends in a direction parallel to the sub scanning direction. The nozzles 21 are configured capable of discharging ink droplets. It should be noted that the nozzle row 22 provided in the printing head 20 is not limited to one, and a plurality of nozzle rows may be provided.

Further, printing is performed by the main scan controlling portion 31 causing the printing head 20 to scan in the main scanning direction, and the discharge controlling portion 34 causing ink to be discharged onto the print medium 1 from some of the nozzles 21 of the printing head 20.

In FIG. 2A and FIG. 2B, ink-discharging nozzles that discharge ink are shown in black, and ink non-discharging nozzles that do not discharge ink are shown by white. The ink droplets corresponding to a print image to be printed are discharged from the ink-discharging nozzle in accordance with positions on the print medium 1 where the ink droplets discharged by the nozzles are to strike. On the other hand, ink is not discharged from the ink non-discharging nozzles.

As shown in FIG. 2A and FIG. 2B, the ink-discharging nozzles are configured of an activated nozzle row 23 that is formed of a plurality of nozzles 21 (black) that is aligned continuously in a part of the nozzle row 22. That is, the nozzles 21 of the nozzle row 22 are configured of the activated nozzle row 23 and an ink non-discharging part 25 formed of the ink non-discharging nozzles.

It should be noted that the activated nozzle row 23 is formed of the nozzles 21 selected by the nozzle selecting portion 33. The nozzle selecting portion 33 selects a plurality of nozzles 21 aligned continuously in a part of the nozzle row 22 as the activated nozzle row 23 (selecting step).

The discharge controlling portion 34 causes ink to be discharged from the activated nozzle row 23 that is selected by the nozzle selecting portion 33 (printing step). At this time, the discharge controlling portion 34 causes ink to be discharged from the activated nozzle row 23 so that an interval in the main scanning direction by which each of the activated nozzle row 23 in each nozzle row 22 discharges ink in each scan becomes an integer multiple of a resolution in the main scanning direction of the image to be printed on the print medium 1.

Then, the nozzle selecting portion 33 re-selects the activated nozzle row 23 each time the activated nozzle row 23 discharges ink for a preset number of times (for example, one time), so that a shift amount of the activated nozzle row 23 from one end of the nozzle row 22 is changed (re-selecting step). In this description, the "shift amount of the activated nozzle row 23 from one end of the nozzle row 22" is a value expressed by a number of nozzles, indicating how much an end of the activated nozzle row 23 on the same side as the one end of the nozzle row 22 is set apart from the one end of the nozzle row 22. For example, when seen from an end on a downstream side (upper side relative to a sheet surface in FIG. 2A and FIG. 2B) in the sub scanning direction of the nozzle row 22, the shift amount becomes 0 in the example shown in FIG. 2A, and the shift amount becomes 1 in the example shown in FIG. 2B.

It should be noted that the nozzle selecting portion 33 simply needs to change the shift amount of the activated nozzle row 23 each time the activated nozzle row 23 discharges the ink for the preset number of times, and the manner by which the shift amount is changed is not particularly limited. For example, although no limitation is made hereto, the shift amount may be changed with a predetermined number of patterns as one cycle as in first to fifth embodiments, or the shift amount may change in random. In whichever cases, banding can be reduced by dispersing boundaries between bands at different positions front and back in the sub scanning direction by the shift amount (position) of the activated nozzle row 23 that discharges ink being changed by the nozzle selecting portion 33.

Then, when the scan for the same line by the main scan controlling portion 31 is completed, the sub scan controlling portion 32 moves the print medium 1 in the sub scanning direction relative to the printing head 20 (sub scanning step). By repeating the above, the inkjet printing device 10 can form the print image on the print medium 1.

Figure 3A:
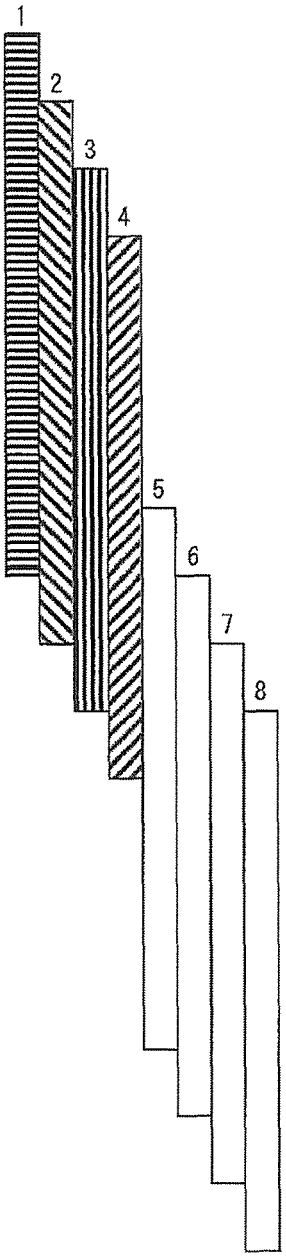
FIG. 3A and FIG. 3B are diagrams for explaining a manner of printing in one embodiment (first embodiment) of the present invention, where
Figure 3B:
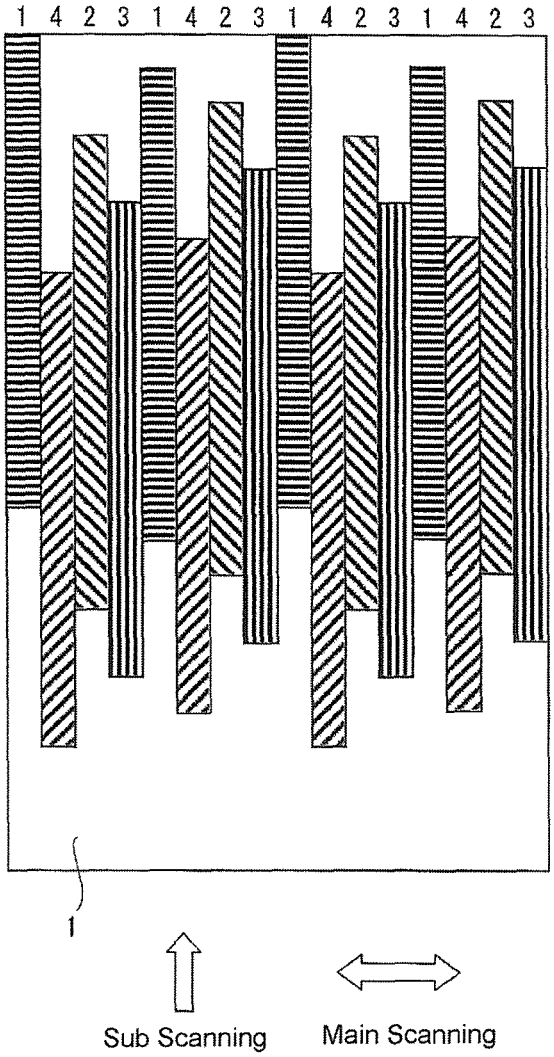

FIG. 3A and FIG. 3B are diagrams for explaining a manner of printing in the present embodiment, where FIG. 3A shows an example of a range in the sub scanning direction that the nozzle row 22 can print in each scan, and FIG. 3B shows an example of the print image printed by plural scans. Specifically, in FIG. 3A, "1" to "8" denote a range in which the nozzle row 22 can perform printing in the sub scanning direction in corresponding one of first to eighth scans. In FIG. 3B, "1" to "4" denote that a vertical line under each of them is printed in corresponding one of the first to fourth scans. It should be noted that positions in a vertical direction (sub scanning direction) in FIG. 3A and FIG. 3B correspond to each other. Further, a width of each vertical line in FIG. 3B is the resolution of the image to be printed on the print medium 1 in the main scanning direction.

That is, in the first scan, the nozzle row 22 can print a range shown in FIG. 3A in the sub scanning direction, and a vertical line on the left end in FIG. 3B is printed by the activated nozzle row 23 being selected as in FIG. 2A. Subsequently, in the same first scan, the activated nozzle row 23 is re-selected as in FIG. 2B, and a fifth vertical line from the left end in FIG. 3B is printed. Subsequently, in the same first scan, the activated nozzle row 23 is re-selected as in FIG. 2A, and a ninth vertical line from the left end in FIG. 3B is printed. Subsequently, in the same first scan, the activated nozzle row 23 is re-selected as in FIG. 2B, and a thirteenth vertical line from the left end in FIG. 3B is printed. Accordingly in the first scan, the vertical lines denoted "1" in FIG. 3B are printed while the re-selection of the activated nozzle row 23 is performed. Then, in the second scan, similarly, vertical lines denoted "2" in FIG. 3B are printed while the re-selection of the activated nozzle row 23 is performed. The same applies to scans of the third and fourth occasions.

Accordingly, in the present embodiment, the discharge controlling portion 34 causes the activated nozzle row 23 to discharge ink so that the interval in the main scanning direction by which each activated nozzle row 23 in each nozzle row 22 discharges ink comes to be of the integer multiple of the resolution of the image to be printed on the print medium 1 in the main scanning direction (which in the present embodiment is 3 times) in one scan. That is, in each scan, the activated nozzle row 23 in one nozzle row 22 is configured to perform printing by skipping one or more vertical lines, and is configured not to print vertical lines that are adjacent to one another in the main scanning direction. Due to this, the following effects can be obtained.

That is, if the vertical lines adjacent to one another in the main scanning direction are printed by the activated nozzle row 23 in the same nozzle row 22, there are cases where the vertical lines stand out undesirably, or banding is slightly visible in the obtained print image, depending on characteristics of the nozzle row 22.

On the contrary, the vertical lines that are adjacent in the main scanning direction within the print image are printed in different scan occasions by configuring the discharge controlling portion 34 to inhibit the activated nozzle row 23 in the same nozzle row 22 from printing the vertical lines that are adjacent in the main scanning direction within the print image in each scan. Due to this, the ranges printed by the same scan occasion are dispersed in the print image, whereby the variation in the print state among the scans of the respective occasions (including transfer error) are averaged, and the vertical lines, banding and the like in the print image can further be suppressed. Due to this, a higher quality print image can be obtained.

Further, according to the present embodiment, as shown in FIG. 3B, since printing is performed while the end portion of the activated nozzle row 23 is shifted, the boundaries between bands are dispersed at different positions front and back in the sub scanning direction, whereby the banding can be reduced, and high quality printing can be performed.

It should be noted that in the example shown in FIG. 3A and FIG. 3B, the interval in the main scanning direction by which each activated nozzle row 23 in each nozzle row 22 discharges ink is 3 times the resolution of the image to be printed on the print medium 1 in the main scanning direction, but the present embodiment is not limited to this, and the interval can be any integer multiple of the resolution. This applies similarly to other embodiments as well.

Second Embodiment

In explaining another embodiment (second embodiment) of the present invention based on FIG. 4, FIG. 5A, and FIG. 5B, such explanation will be as follows. It should be noted that for the sake of convenience of explanation, components having the same function as that described in the previous embodiment will be given the same reference signs, and the explanation thereof will be omitted.

Figure 4:
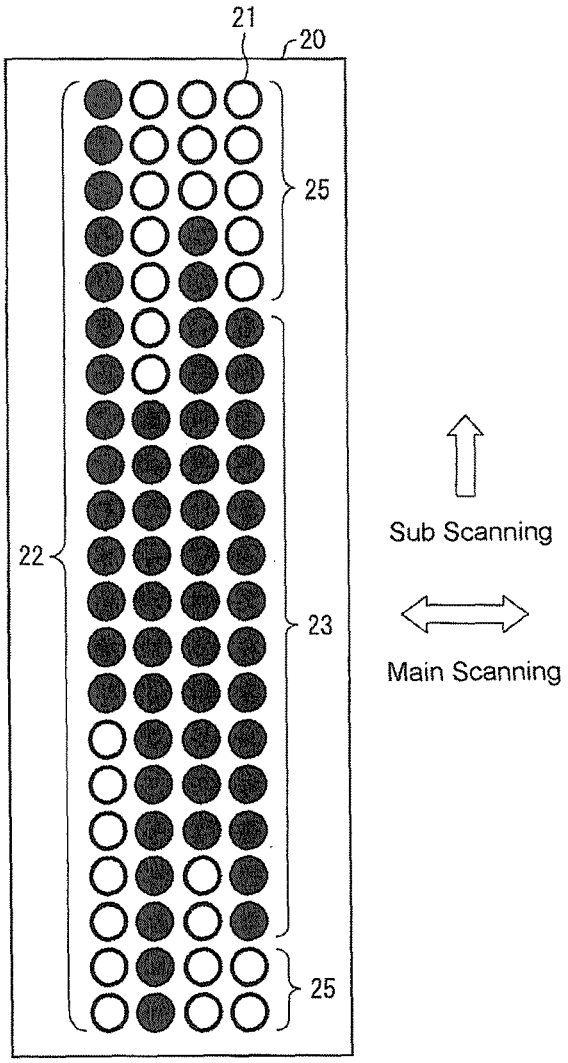
FIG. 4 is a schematic diagram showing an example of an overview configuration of a printing head of one embodiment (second embodiment) of the present invention.

FIG. 4 is a schematic diagram showing an example of an overview configuration of a printing head 20 of the present embodiment. As shown in FIG. 4, in the present embodiment, the printing head 20 includes a plurality of the nozzle rows 22 that discharges a same color ink.

Figure 5A:
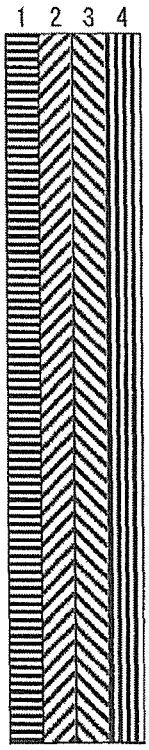
FIG. 5A and FIG. 5B are diagrams for explaining a manner of printing in one embodiment (second embodiment) of the present invention, where
Figure 5B:
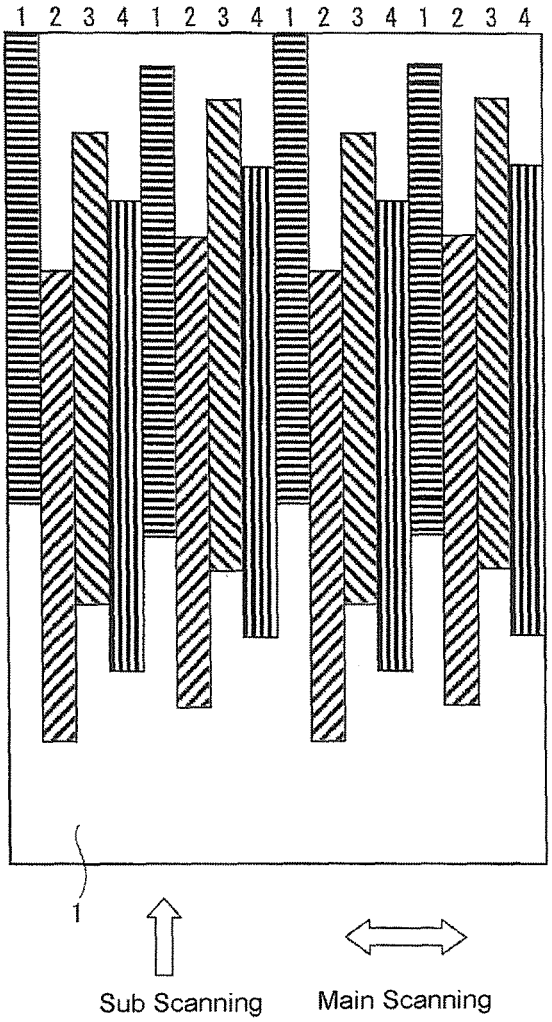

FIG. 5A and FIG. 5B are diagrams for explaining a manner of printing in the present embodiment, where FIG. 5A shows an example of a range in the sub scanning direction that the respective nozzle rows 22 can perform printing in one scan, and FIG. 5B shows an example of the print image printed by the one scan. Specifically, in FIG. 5A, "1" to "4" denote a range in which first to fourth nozzle rows 22 can respectively perform printing in the sub scanning direction. In FIG. 5B, "1" to "4" denote that a vertical line under each of them is printed by the activated nozzle row 23 in the corresponding one of the first to fourth nozzle rows 22. It should be noted that positions in a vertical direction (sub scanning direction) in FIG. 5A and FIG. 5B correspond to each other.

In the present embodiment as well, similar to the first embodiment, the discharge controlling portion 34 can cause the activated nozzle rows 23 to discharge ink so that the interval in the main scanning direction by which each activated nozzle row 23 in each nozzle row 22 discharges ink comes to be of the integer multiple of the resolution of the image to be printed on the print medium 1 in the main scanning direction (which in the present embodiment is 3 times) in one scan. In addition, since the printing head 20 includes a plurality of the nozzle rows 22 that discharges a same color ink, the discharge controlling portion 34 can perform control so that the vertical lines that are adjacent in the main scanning direction within the print image can be printed by the activated nozzle rows 23 of the different nozzle rows 22 in one scan. Due to this, as compared to the case where the adjacent vertical lines are printed by the different scans, printing can be performed at high speed.

Further, by performing printing using a plurality of the nozzle rows 22 that discharges a same color ink, the property variations among the respective nozzle rows 22 are further averaged because the regions to be printed by the activated nozzle row 23 in the same nozzle row 22 are dispersed within the print image, whereby a higher quality print image can be obtained.

It should be noted that in one aspect, in a case where a voluntary nozzle row 22 includes a broken nozzle from which ink cannot be discharged due to a damage or the like, the discharge controlling portion 34 may control so as to perform printing using a nozzle 21 of another nozzle row 22 that is different from the voluntary nozzle row 22, instead of the broken nozzle (perform recovery).

Further, in the above, a case where a cycle of the repeating pattern printed on the print medium 1 is same as the number of the nozzle rows 22 of the same color provided in the printing head 20, but the present embodiment is not limited to this, and the cycle of the repeating pattern may be different from the number of the nozzle rows 22. With the printing head 20 including at least two nozzle rows 22 for a same color ink, the discharge controlling portion 34 can perform control so that the vertical lines that are adjacent in the main scanning direction within the print image can be printed by the activated nozzle rows 23 of the different nozzle rows 22 in one scan, and similar effects can thereby be obtained.

Third Embodiment

In explaining another embodiment (third embodiment) of the present invention based on FIG. 6A and FIG. 6B, such explanation will be as follows. It should be noted that for the sake of convenience of explanation, components having the same function as that described in the previous embodiments will be given the same reference signs, and the explanation thereof will be omitted.

Figure 6A:
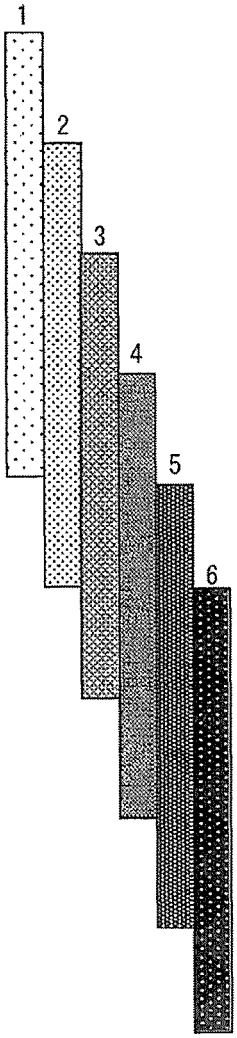
FIG. 6A and FIG. 6B are diagrams for explaining a manner of printing in one embodiment (third embodiment) of the present invention, where
Figure 6B:
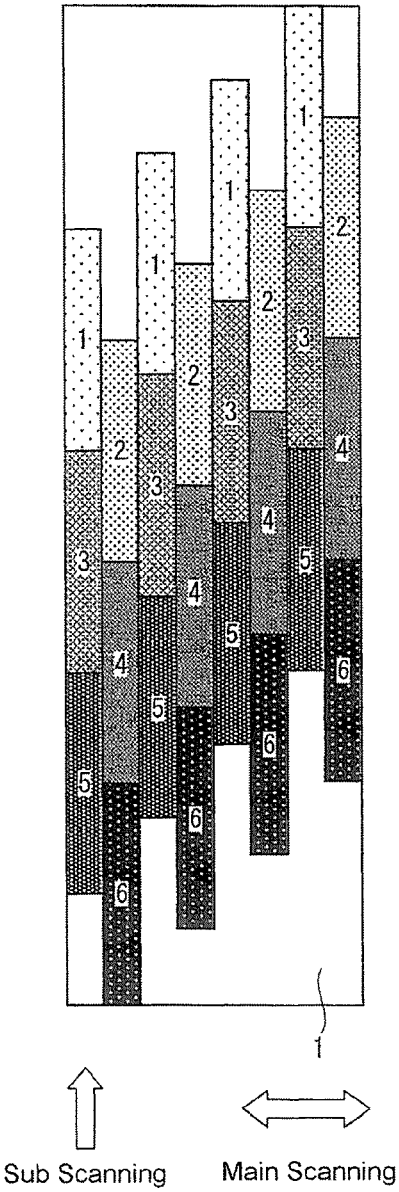

FIG. 6A and FIG. 6B are diagrams for explaining a manner of printing in the present embodiment, where FIG. 6A shows an example of a range in the sub scanning direction that the nozzle row 22 can perform printing in each scan, and FIG. 6B shows an example of the print image printed by plural scans. Specifically, in FIG. 6A, "1" to "6" denote a range in which the nozzle row 22 can perform printing in the sub scanning direction in corresponding one of first to sixth scans. In FIG. 6B, "1" to "6" denote that regions thereof are printed in corresponding one of the first to sixth scans. It should be noted that positions in a vertical direction (sub scanning direction) in FIG. 6A and FIG. 6B correspond to each other.

That is, in the first scan, regions on first, third, fifth, and seventh vertical lines from the left end in FIG. 6B are printed. Then, in the second scan, regions on second, fourth, sixth, and eighth vertical lines from the left end in FIG. 6B are printed. Then, in the third scan, regions on first, third, fifth, and seventh vertical lines from the left end in FIG. 6B, which are connected to a lower side of the regions that have been printed in the first scan, are printed. Next, in the fourth scan, regions on second, fourth, sixth, and eighth vertical lines from the left end in FIG. 6B, which are connected to a lower side of the regions that have been printed in the second scan, are printed. Then, in the fifth scan, regions on first, third, fifth, and seventh vertical lines from the left end in FIG. 6B, which are connected to a lower side of the regions that have been printed in the third scan, are printed. Next, in the sixth scan, regions on second, fourth, sixth, and eighth vertical lines from the left end in FIG. 6B, which are connected to a lower side of the regions that have been printed in the fourth scan, are printed.

Accordingly, in the present embodiment, the discharge controlling portion 34 causes the activated nozzle row 23 to discharge ink so that the interval in the main scanning direction by which each activated nozzle row 23 in each nozzle row 22 discharges ink comes to be of the integer multiple of the resolution of the image to be printed on the print medium 1 in the main scanning direction (which in the present embodiment is 1 time) in one scan, pixels (vertical lines) aligned in the sub scanning direction in the image to be printed on the print medium 1 are formed by every N times of scans (where N is an integer of 1 or more. In the present embodiment, N=1). Due to this, the following effects can be obtained.

That is, by forming the pixels (vertical lines) aligned in the sub scanning direction in the image to be printed on the print medium 1 by the every N times of scans, errors in a transfer operation in the sub scanning direction among the scans of the respective occasions are averaged, and a higher quality print image can be obtained. For example, some of pixels may overlap at the boundary between the bands by the transfer errors in the sub scanning direction and a stripe pattern may thereby be generated, but according to the present embodiment, the errors in the transfer operation in the sub scanning direction among the scans of the respective occasions can be averaged since the vertical lines are printed with an interval worth at least one or more occasions (that is, the vertical lines are not printed by consecutive scans), and thus the stripe pattern can further be suppressed.

Fourth Embodiment

In explaining another embodiment (fourth embodiment) of the present invention based on FIG. 7, FIG. 8A, and FIG. 8B, such explanation will be as follows. It should be noted that for the sake of convenience of explanation, components having the same function as that described in the previous embodiments will be given the same reference signs, and the explanation thereof will be omitted.

In the third embodiment, when printing is to be performed in a manner shown in FIGS. 6A and 6B, the printing head 20 may include a plurality of nozzle rows 22 of a same color as in the second embodiment, and the printing may be performed by using the plurality of nozzle rows 22.

Figure 7:
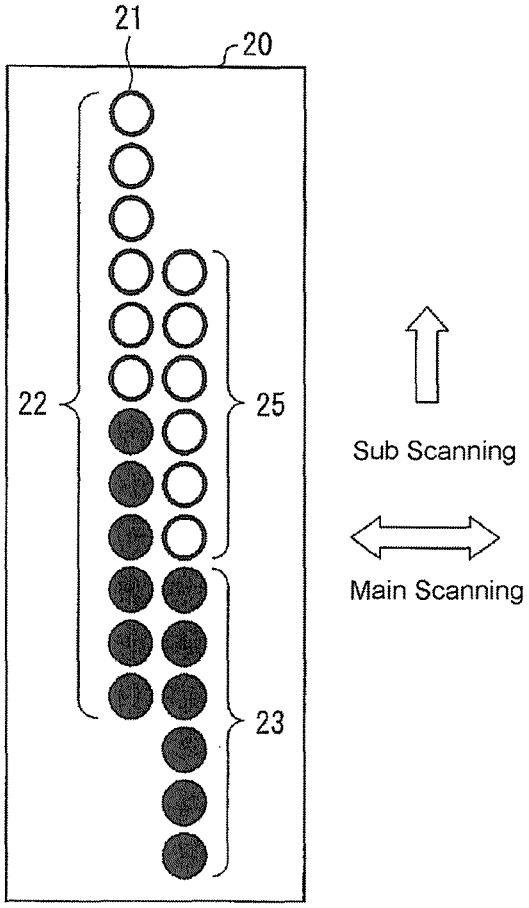
FIG. 7 is a schematic diagram showing an example of an overview configuration of a printing head of one embodiment (fourth embodiment) of the present invention.

At this time, the printing head 20 as shown in FIG. 4 may be used, but in the present embodiment, a configuration will be described that uses a printing head 20 in which the plurality of nozzle rows 22 as shown in FIG. 7 is arranged such that some of their nozzles 21 are arranged adjacent to one another in the main scanning direction (a so-called staggered head).

FIG. 7 is a schematic diagram showing an example of an overview configuration of the printing head 20 of the present embodiment. As shown in FIG. 7, in the present embodiment, the printing head 20 includes two nozzle rows 22 in which some of their nozzles 21 are arranged adjacent to one another in the main scanning direction. That is, the adjacent nozzle rows 22 are arranged so that they are offset relative to each other in the sub scanning direction.

Figure 8A:
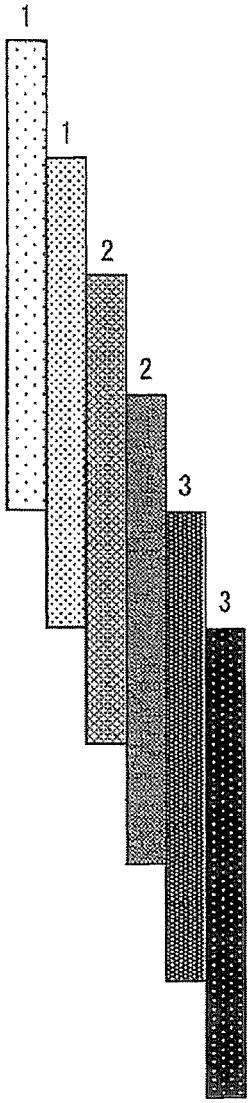
FIG. 8A and FIG. 8B are diagrams for explaining a manner of printing in one embodiment (fourth embodiment) of the present invention, where
Figure 8B:
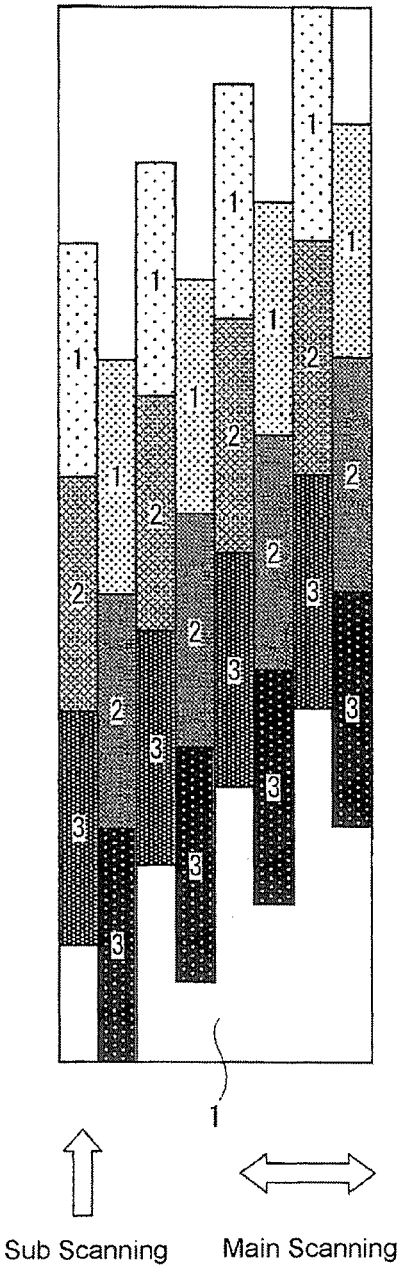

FIG. 8A and FIG. 8B are diagrams for explaining a manner of printing in the present embodiment, where FIG. 8A shows an example of a range in the sub scanning direction that the respective nozzle rows 22 can perform printing in one scan, and FIG. 8B shows an example of the print image printed by the one scan. Specifically, in FIG. 8A, "1" to "3" denote a range that can be printed in the sub scanning direction in corresponding one of first to third scans. It should be noted that the left side indicates the range in the sub scanning direction that can be printed by the nozzle row 22 on the left side, and the right side indicates the range in the sub scanning direction that can be printed by the nozzle row 22 on the right side. In FIG. 8B, "1" to "3" denote that regions thereof are printed in corresponding one of the first to third scans. It should be noted that regions on first, third, fifth, and seventh vertical lines from the left end in FIG. 8B are printed by the nozzle row 22 on the left side, and regions on second, fourth, sixth, and eighth vertical lines from the left end in FIG. 8B are printed by the nozzle row 22 on the right side. It should be noted that positions in a vertical direction (sub scanning direction) in FIG. 8A and FIG. 8B correspond to each other.

Accordingly, in the present embodiment, the discharge controlling portion 34 controls the activated nozzle rows 23 so that the activated nozzle row 23 of the same nozzle row 22 forms the pixels (vertical lines) aligned in the sub scanning direction of the image to be printed on the print medium 1. For example, the vertical line on the left end in FIG. 8B is formed by the nozzle row 22 on the left side, and the second vertical line from the left end in FIG. 8B is formed by the nozzle row 22 on the right side.

Here, the shape of the bands formed in the respective scans is same in all of the first to third scans. Since each band has the same shape, the print image can be formed without any gaps. Here, in the present embodiment, the printing head 20 in which the two nozzle rows 22 are arranged by being offset (the so-called staggered head) as shown in FIG. 7 is used, and the same vertical line is printed by the same nozzle row 22; thus, the identical band shapes can suitably be formed in each scan.

Further, since the vertical lines are printed by the same nozzle row 22, shifting of printing position in the main scanning direction in each vertical line can be suppressed. That is, in the case of printing the vertical lines by a plurality of nozzle rows 22, since the printing position in the main scanning direction of each nozzle row 22 differs due to a property variation in the respective nozzle rows 22, the shifting of the printing position in the main scanning direction is generated accompanying the switch between the nozzle rows 22 that perform printing in each vertical line, but such a shifting can be suppressed by printing the vertical lines by the same nozzle row 22.

Fifth Embodiment

In explaining another embodiment (fifth embodiment) of the present invention based on FIG. 9, FIG. 10A and FIG. 10B, and FIG. 11A to FIG. 11C, such explanation will be as follows. It should be noted that for the sake of convenience of explanation, components having the same function as that described in the previous embodiments will be given the same reference signs, and the explanation thereof will be omitted.

In the present embodiment, printing is performed by discharging ink onto the print medium 1 from at least one nozzle 21 extending discontinuously from at least one end of the activated nozzle row 23, in addition to the activated nozzle row 23.

Figure 9:
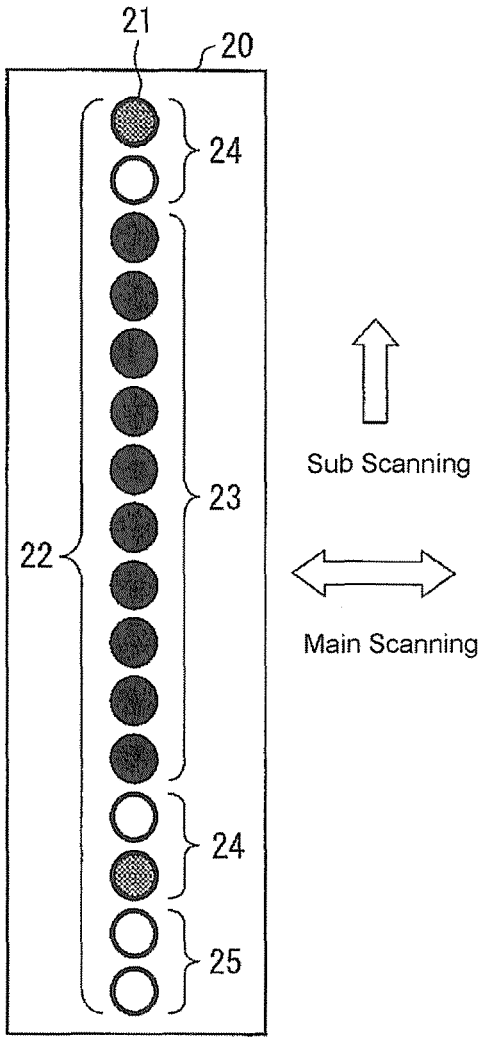
FIG. 9 is a schematic diagram showing an example of an overview configuration of a printing head of one embodiment (fifth embodiment) of the present invention.

FIG. 9 is a schematic diagram showing an example of an overview configuration of the printing head 20 of the present embodiment. In FIG. 9, ink-discharging nozzles that discharge ink are shown in black and gray, and ink non-discharging nozzles that do not discharge ink are shown by white. The ink droplets corresponding to a print image to be printed are discharged from the ink-discharging nozzle in accordance with positions on the print medium 1 where the ink droplets discharged by the nozzles are to strike. On the other hand, ink is not discharged from the ink non-discharging nozzles.

As shown in FIG. 9, the ink-discharging nozzles are configured of the activated nozzle row 23 including a plurality of nozzles 21 (black) aligned continuously in a part of the nozzle row 22, and at least one nozzle 21 (gray) extending discontinuously from at least one end of the activated nozzle row 23. That is, the nozzles 21 of the nozzle row 22 are configured of the activated nozzle row 23, dotted line parts 24 extending discontinuously at least from one end of the activated nozzle row 23, and an ink non-discharging part 25 formed of ink non-discharging nozzles.

It should be noted that the activated nozzle row 23 is formed of the nozzles 21 selected by the nozzle selecting portion 33, similar to the previous embodiments. The nozzle selecting portion 33 selects and re-selects a plurality of nozzles 21 aligned continuously in a part of the nozzle row 22 as the activated nozzle row 23.

In the present embodiment, the discharge controlling portion 34 causes the activated nozzle row 23 and the at least one nozzle 21 extending discontinuously from at least one end of the activated nozzle row 23 (nozzles 21 shown by gray in FIG. 9) selected by the nozzle selecting portion 33 to discharge ink.

Figure 10A:
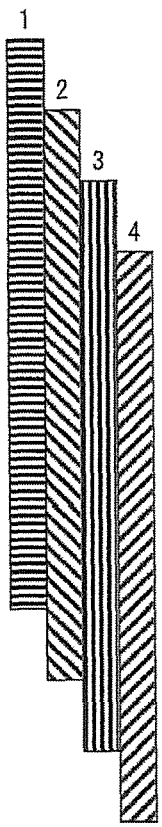
FIG. 10A and FIG. 10B are diagrams for explaining a manner of printing in one embodiment (fifth embodiment) of the present invention, where
Figure 10B:
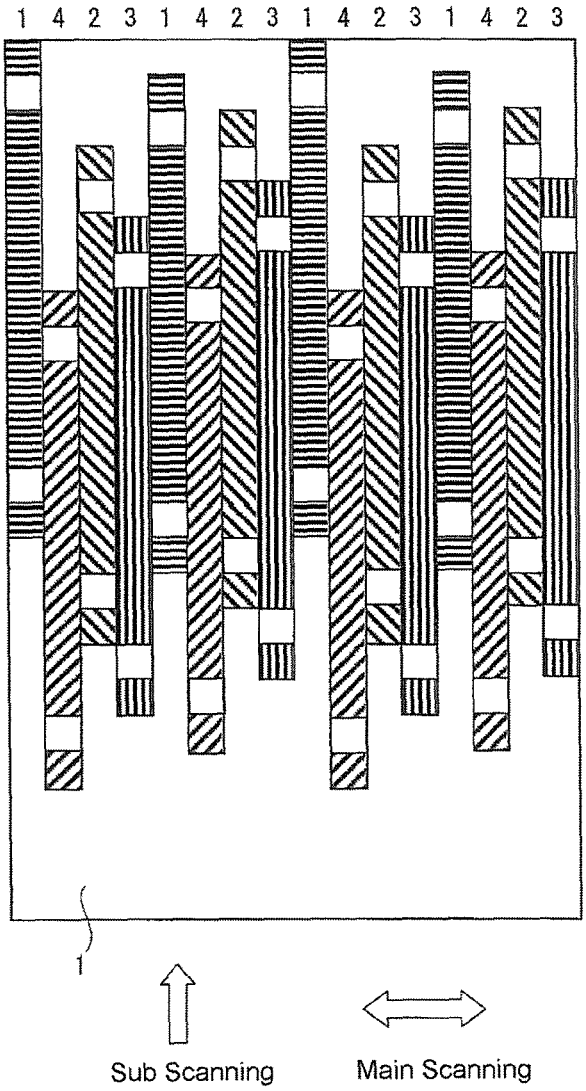

FIG. 10A and FIG. 10B are diagrams for explaining a manner of printing in the present embodiment, where FIG. 10A shows an example of a range in the sub scanning direction that the nozzle row can print in each scan, and FIG. 10B shows an example of the print image printed by plural scans.

As shown in FIG. 10B, in the present embodiment, the image printed by one nozzle row 22 in one scan includes a dotted line portion at an end thereof.

Figure 11A:
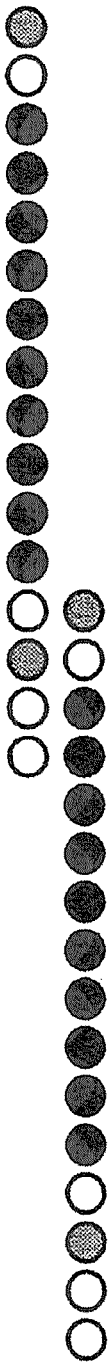
FIG. 11A to FIG. 11C are diagrams explaining variations in a nozzle position for discharging ink in one embodiment (fifth embodiment) of the present invention.

Further, as shown in FIG. 11A, the dotted line portion printed in the scan of a voluntary occasion (center portion on the left side) is complemented by the dotted line portion printed in the scan of another occasion (center portion on the right side).

Accordingly, in a voluntary vertical line, an intermediate region that is printed by the discontinuous nozzles is provided between regions to be printed by the activated nozzle row 23 configured of the continuous nozzles 21. By providing such an intermediate region, the vertical lines can be freed from visibly standing out. That is, in the present embodiment, the intermediate region is provided by discharging ink from at least one nozzle 21 extending discontinuously from at least one end of the activated nozzle row 23, in addition to the activated nozzle row 23, and complementing the regions to be printed by the nozzles 21 extending discontinuously within the adjacent bands. The presence of this intermediate region prevents the vertical lines from standing out more than necessary, and a higher quality print image can be obtained.

It should be noted that at least one nozzle 21 extending discontinuously from at least one end of the activated nozzle row 23 is not limited to the case of extending from both ends of the activated nozzle row 23 as in FIG. 9. For example, such a nozzle 21 may extend from one of the ends of the activated nozzle row 23.

Figure 11B:
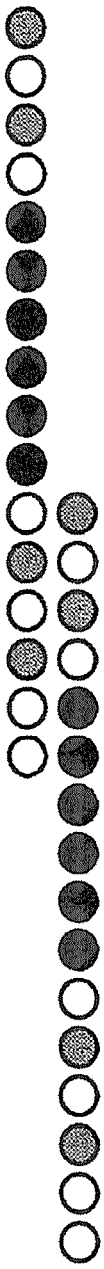
Figure 11C:
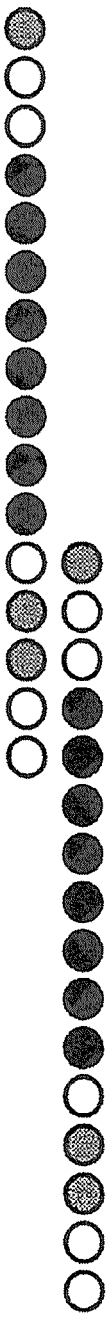

Further, at least one nozzle 21 extending discontinuously from at least one end of the activated nozzle row 23 is not limited to the case where only one nozzle 21 extends as in FIG. 9. For example, as shown in FIG. 11B, two or more nozzles 21 may extend from an end of the activated nozzle row 23, and these may complement each other among plural scans. Further, at least one nozzle 21 extending discontinuously from at least one end of the activated nozzle row 23 is not limited to the case of extending alternately from an end of the activated nozzle row 23 as in FIG. 9. For example, as shown in FIG. 11C, a nozzle 21 may extend in two intervals from an end of the activated nozzle row 23, and these may complement each other among plural scans.

(Software Implemented Example)

A control block of the inkjet printing device 10 (especially, the main scan controlling portion 31, the sub scan controlling portion 32, the nozzle selecting portion 33, and the discharge controlling portion 34) may be implemented by logic circuits (hardware) formed on integrated circuits (IC chips) and the like, or may be implemented by software using a CPU (Central Processing Unit).

In the latter case, the inkjet printing device 10 includes the CPU for executing instructions of a program being the software for implementing the respective functions, a ROM (Read Only Memory) or a storage device (which are collectively termed a "recording medium") in which the program and various data are stored in a computer (or CPU)-readable manner, a RAM (Random Access Memory) for expanding the program, and the like. Further, an aim of the present invention is achieved by a computer (or the CPU) reading the program from the recording medium and executing the same. As the recording medium, "a non-transitory, tangible medium", for example, a tape, a disk, a card, a semiconductor memory, a programmable logic circuit or the like may be used. Further, the program may be provided to the computer via a voluntary transmission medium (communication network, broadcast waves, or the like) that can transmit the program. It should be noted that the present invention may be implemented in a form of data signals embedded in transfer waves, in which the program is implemented by electronic transmission.

(Supplemental Information)

The inkjet printing device 10 according to the first to fifth embodiments includes: a printing head 20 including at least one nozzle row 22 having a plurality of nozzles 21 aligned therein; a nozzle selecting portion 33 that selects, for each nozzle row 22, a plurality of nozzles 21 aligned continuously in a part of the nozzle row 22 as an activated nozzle row 23; a main scan controlling portion 31 that causes the printing head 20 to scan in a main scanning direction intersecting the nozzle row 22; and a sub scan controlling portion 32 that causes a print medium 1 to move with respect to the printing head 20 in a sub scanning direction that is parallel to a direction along which the nozzle row 22 extends, wherein printing is performed by the main scan controlling portion 31 causing the printing head 20 to scan in the main scanning direction and the activated nozzle row 23 discharging ink onto the print medium 1, the nozzle selecting portion 33 reselects the activated nozzle row 23 each time when the activated nozzle row 23 has discharged ink for a preset number of times, such that a shift amount of the activated nozzle row 23 from one end of the nozzle row 22 is changed, and printing is performed such that in each scan, an interval by which the activated nozzle row 23 in each nozzle row 22 discharges ink in the main scanning direction is set to be an integer multiple of a resolution of an image to be printed on the print medium 1 in the main scanning direction.

According to the above configuration, printing is performed by discharging ink from the activated nozzle row 23. At this occasion, the shift amount (position) of the activated nozzle row 23 that is to discharge ink is changed by the nozzle selecting portion 33, so that banding can be reduced by dispersing boundaries between bands at different positions front and back in the sub scanning direction.

Here, if vertical lines adjacent to each other in the main scanning direction are to be printed by the activated nozzle row 23 in the same nozzle row 22, there are cases where the vertical lines stand out, or the banding is slightly visible in the obtained print image due to properties provided by the nozzle row 22. On the contrary, according to the above configuration, printing is performed in each scan so that the interval by which the activated nozzle row 23 in each nozzle row 22 discharges ink in the main scanning direction is set to be the integer multiple of the resolution of the image to be printed on the print medium 1 in the main scanning direction. That is, in each scan, the activated nozzle row 23 in the same nozzle row 22 is configured not to print the vertical lines that are adjacent in the main scanning direction within the print image. Accordingly, the vertical lines that are adjacent in the main scanning direction within the print image are printed by the activated nozzle rows 23 of different nozzle rows 22, or by different scans. Thus, regions printed by the activated nozzle row 23 in the same nozzle row 22, or regions printed by the same scan are dispersed within the print image, so that property variations among the nozzle row 22 or variations in print state (including transfer error) among the scans are averaged, whereby the vertical lines, the banding, and the like in the print image can further be suppressed. Due to this, a higher quality print image can be obtained.

In the inkjet printing device 10 according to the second and fourth embodiments, the printing head 20 includes a plurality of the nozzle rows 22 that discharges a same color ink.

As described above, in the inkjet printing device 10 according to the first to fifth embodiments, the vertical lines that are adjacent in the main scanning direction within the print image are printed either (i) by the activated nozzle rows 23 of different nozzle rows 22, or (ii) by the different scans; and due to this, a high quality print image can be obtained. Here, according to the above configuration, since the printing head 20 includes a plurality of the nozzle rows 22 that discharges a same color ink, the vertical lines that are adjacent in the main scanning direction within the print image can be printed (i) by the activated nozzle rows 23 of different nozzle rows 22 in each scan. Due to this, as compared to the case where the adjacent vertical lines are printed (ii) by the different scans, printing can be performed at high speed.

Further, by performing the printing using a plurality of the nozzle rows 22 that discharges a same color ink, the property variations among the nozzle rows 22 are further averaged, and a higher quality print image can be obtained.

Further, with the printing head 20 including a plurality of the nozzle rows 22 that discharges a same color ink, in a case where a voluntary nozzle row 22 includes a broken nozzle from which ink cannot be discharged due to a damage or the like, printing can be performed using a nozzle 21 of another nozzle row 22 instead of the broken nozzle (perform recovery).

In the inkjet printing device according to the fourth embodiment, the plurality of the nozzle rows 22 is arranged such that some of the nozzles 21 become adjacent to each other in the main scanning direction, in each scan, printing is performed so that a position in the main scanning direction where the activated nozzle row 23 of each nozzle row 22 discharges ink differs from each other, and the pixels aligned in the sub scanning direction in the image to be printed on the print medium 1 is formed by the activated nozzle row 23 in a same nozzle row 22.

According to the above configuration, the plurality of the nozzle rows 22 is arranged so that some of their nozzles 21 become adjacent to each other in the main scanning direction. That is, the adjacent nozzle rows 22 are arranged so that they are offset relative to each other in the sub scanning direction.

In printing using a plurality of nozzle rows 22 arranged by being offset each other, printing is performed so that pixels aligning in the sub scanning direction (vertical lines) in the image to be printed on the print medium 1 are formed by the activated nozzle row 23 in the same nozzle row 22, and each band can suitably be printed thereby. In addition, since the vertical lines are printed by the same nozzle row 22, shifting of printing position in the main scanning direction in each vertical line can be suppressed.

That is, in the case of printing the vertical lines by a plurality of nozzle rows 22, since the printing position in the main scanning direction of each nozzle row 22 differs due to a property variation in the respective nozzle rows 22, the shifting of the printing position in the main scanning direction is generated accompanying the switch between the nozzle rows 22 that perform the printing in each vertical line, but such a shifting can be suppressed by printing the vertical lines by the same nozzle row 22.

In the inkjet printing device 10 according to the fifth embodiment, printing is performed by discharging ink onto the print medium 1 from at least one nozzle 21 extending discontinuously from at least one end of the activated nozzle row 23, in addition to the activated nozzle row 23.

According to the above configuration, in addition to the activated nozzle row 23, ink is discharged from the nozzle 21 extending discontinuously from at least one end of the activated nozzle row 23. Due to this, among the vertical lines in the print image, an intermediate region that is printed by the discontinuous nozzle 21 can be provided between the portions to be printed by the continuous nozzles 21 (activated nozzle row 23). Due to this, the vertical lines can be freed from visibly standing out. Accordingly, a higher quality print image can be obtained.

In the inkjet printing device 10 according to the third and fourth embodiments, pixels aligned in the sub scanning direction in the image to be printed on the print medium 1 may be formed by every N scan (N being an integer of one or more).

According to the above configuration, the pixels aligned in the sub scanning direction (vertical line) in the image to be printed on the print medium 1 are formed by every N scan (N being an integer of one or more). Due to this, errors in a transfer operation in the sub scanning direction among scans of the respective occasions can be averaged, and a higher quality print image can be obtained. For example, some of pixels overlap at a boundary between the bands by the transfer errors in the sub scanning direction and a stripe pattern may thereby be generated, but according to the above configuration, the errors in the transfer operation in the sub scanning direction among the scans of the respective occasions can be averaged, and the stripe pattern can further be suppressed.

A printing method according to the first to fifth embodiments is a printing method that uses an inkjet printing device 10 including a printing head 20 that includes at least one nozzle row 22 having a plurality of nozzles 21 aligned therein, the method including: a nozzle selecting step of selecting, for each nozzle row 22, a plurality of nozzles 21 aligned continuously in a part of the nozzle row 22 as an activated nozzle row 23; a printing step of performing printing by scanning the printing head 20 in a main scanning direction intersecting the nozzle row 22, and discharging ink onto a print medium 1 from the activated nozzle row 23; a nozzle re-selecting step of changing a shift amount of the activated nozzle row 23 from one end of the nozzle row 22 each time when the activated nozzle row 23 has discharged ink for a preset number of times; and a sub scanning step of moving the print medium 1 with respect to the printing head 20 in a sub scanning direction that is parallel to a direction along which the nozzle row 22 extends, wherein in the printing step, printing is performed such that in each scan, an interval by which the activated nozzle row 23 in each nozzle row 22 discharges ink in the main scanning direction is set to be an integer multiple of a resolution of an image to be printed on the print medium 1 in the main scanning direction.

According to the above configuration, an effect similar to that of the inkjet printing device 10 according to the first to fifth embodiments can be achieved.

The present invention is not limited to the aforementioned respective embodiments; various modifications can be made within the scope indicated in the claims, and embodiments obtained by suitably combining the technical features disclosed respectively in different embodiments are also included within the technical scope of the present invention.

INDUSTRIAL APPLICABILITY

The present invention can be used in a manufacturing field of printing devices, a manufacturing field of printed objects and the like.

The invention claimed is:

1. An inkjet printing device, comprising:

a printing head including at least one nozzle row having a plurality of nozzles aligned therein;

a nozzle selecting unit that selects, for each nozzle row, a plurality of nozzles aligned continuously in a part of the nozzle row as an activated nozzle row;

a main scan controlling unit that causes the printing head to scan in a main scanning direction intersecting the nozzle row; and a sub scan controlling unit that causes a print medium to move with respect to the printing head in a sub scanning direction that is parallel to a direction along which the nozzle row extends, wherein printing is performed by the main scan controlling unit causing the printing head to scan in the main scanning direction and the activated nozzle row discharging ink onto the print medium, the nozzle selecting unit reselects the activated nozzle row each time when the activated nozzle row has discharged ink for a preset number of times, such that a shift amount of the activated nozzle row from one end of the nozzle row is changed and a number of the nozzles constituting the activated nozzle row is not changed, and in each scan, an interval by which the activated nozzle row in each nozzle row discharges ink in the main scanning direction is set to be an integer multiple of a resolution of an image to be printed on the print medium in the main scanning direction, wherein the printing head includes a plurality of the nozzle rows that discharge a same color ink;

the plurality of the nozzle rows is arranged such that some of the nozzles become adjacent to each other in the main scanning direction, in each scan, printing is performed so that position in the main scanning direction where the activated nozzle row of each nozzle row discharges ink differs from each other, and pixels aligned in the sub scanning direction in the image to be printed on the print medium are formed by the activated nozzle row in a same nozzle row, wherein printing is performed by discharging ink onto the print medium from at least one nozzle extending discontinuously from at least one end of the activated nozzle row, in addition to the activated nozzle row.

2. The inkjet printing device according to claim 1, wherein pixels aligned in the sub scanning direction in the image to be printed on the print medium are formed by every N scan, wherein N is an integer of one or more.

3. A printing method that uses an inkjet printing device including a printing head that includes at least one nozzle row having a plurality of nozzles aligned therein, the printing method comprising:

a nozzle selecting step of selecting, for each nozzle row, a plurality of nozzles aligned continuously in a part of the nozzle row as an activated nozzle row;

a printing step of performing printing by scanning the printing head in a main scanning direction intersecting the nozzle row, and discharging ink onto a print medium from the activated nozzle row;

a nozzle re-selecting step of changing a shift amount of the activated nozzle row from one end of the nozzle row each time when the activated nozzle row has discharged ink for a preset number of times and a number of the nozzles constituting the activated nozzle row is not changed; and a sub scanning step of moving the print medium with respect to the printing head in a sub scanning direction that is parallel to a direction along which the nozzle row extends, wherein in the printing step, printing is performed such that in each scan, an interval by which the activated nozzle row in each nozzle row discharges ink in the main scanning direction is set to be an integer multiple of a resolution of an image to be printed on the print medium in the main scanning direction, wherein the printing head includes a plurality of the nozzle rows that discharge a same color ink;

the plurality of the nozzle rows is arranged such that some of the nozzles become adjacent to each other in the main scanning direction, in each scan, printing is performed so that position in the main scanning direction where the activated nozzle row of each nozzle row discharges ink differs from each other, and pixels aligned in the sub scanning direction in the image to be printed on the print medium are formed by the activated nozzle row in a same nozzle row, wherein printing is performed by discharging ink onto the print medium from at least one nozzle extending discontinuously from at least one end of the activated nozzle row, in addition to the activated nozzle row.

* * * * *